US005117900A

United States Patent [19]

Cox

[11] Patent Number: 5,117,900

[45] Date of Patent: Jun. 2, 1992

[54] SYSTEM FOR PROVIDING INDIVIDUAL COMFORT CONTROL

[75] Inventor: Robert A. Cox, Stoddard, Wis.

[73] Assignee: American Standard Inc., New York, N.Y.

[21] Appl. No.: 686,228

[22] Filed: Apr. 15, 1991

[51] Int. Cl.[5] ..... F24D 5/10

[52] U.S. Cl. ..... 165/53; 236/49.3; 454/256; 454/292

[58] Field of Search ..... 236/51, 49.3; 165/53; 454/292, 256

[56] References Cited

U.S. PATENT DOCUMENTS

| | | | |
|---|---|---|---|
| 2,730,866 | 1/1956 | Baker et al. | 98/40.02 X |
| 2,854,914 | 10/1958 | Galbraith | 98/13 |
| 4,107,941 | 8/1978 | Hamilton | 62/186 |
| 4,135,440 | 1/1979 | Schmidt et al. | 98/31 |
| 4,223,831 | 9/1980 | Szarka | 236/47 |
| 4,328,926 | 5/1982 | Hall, Jr. | 236/49.3 |
| 4,378,727 | 4/1983 | Doss | 98/33 |
| 4,391,913 | 7/1983 | Keldmann | 236/36 |
| 4,433,719 | 2/1984 | Cherry et al. | 165/26 |
| 4,646,966 | 3/1987 | Nassbaum | 237/49 |
| 4,686,890 | 8/1987 | Stouffer et al. | 98/2 |
| 4,729,293 | 3/1988 | Tsunoda et al. | 98/40.24 |
| 4,794,851 | 1/1989 | Kurrle | 98/40.18 |
| 4,795,089 | 1/1989 | Tezuka et al. | 236/49 |
| 4,824,012 | 4/1989 | Tate | 236/49.5 |
| 4,860,642 | 8/1989 | Nussbaum | 98/40.19 |
| 4,860,950 | 8/1989 | Reeser et al. | 236/51 |
| 4,872,397 | 10/1989 | Demeter et al. | 98/31.6 |
| 4,905,475 | 3/1990 | Tuomi | 62/3.3 |
| 4,928,582 | 5/1990 | Elfverson | 98/2 |
| 4,966,069 | 10/1990 | Muller et al. | 98/40.11 |
| 4,969,508 | 11/1990 | Tate et al. | 165/22 |

*Primary Examiner*—William E. Wayner

*Attorney, Agent, or Firm*—William J. Beres; William O'Driscoll; Peter D. Ferguson

[57] ABSTRACT

A system for providing individual comfort control. The system includes means, such as an air diffuser, for distributing conditioned air into an environment; a personal comfort device for selectively providing conditioned air to a portion of the environment; and means for remotely controlling the operation of the personal comfort device.

7 Claims, 3 Drawing Sheets

FIG. 1
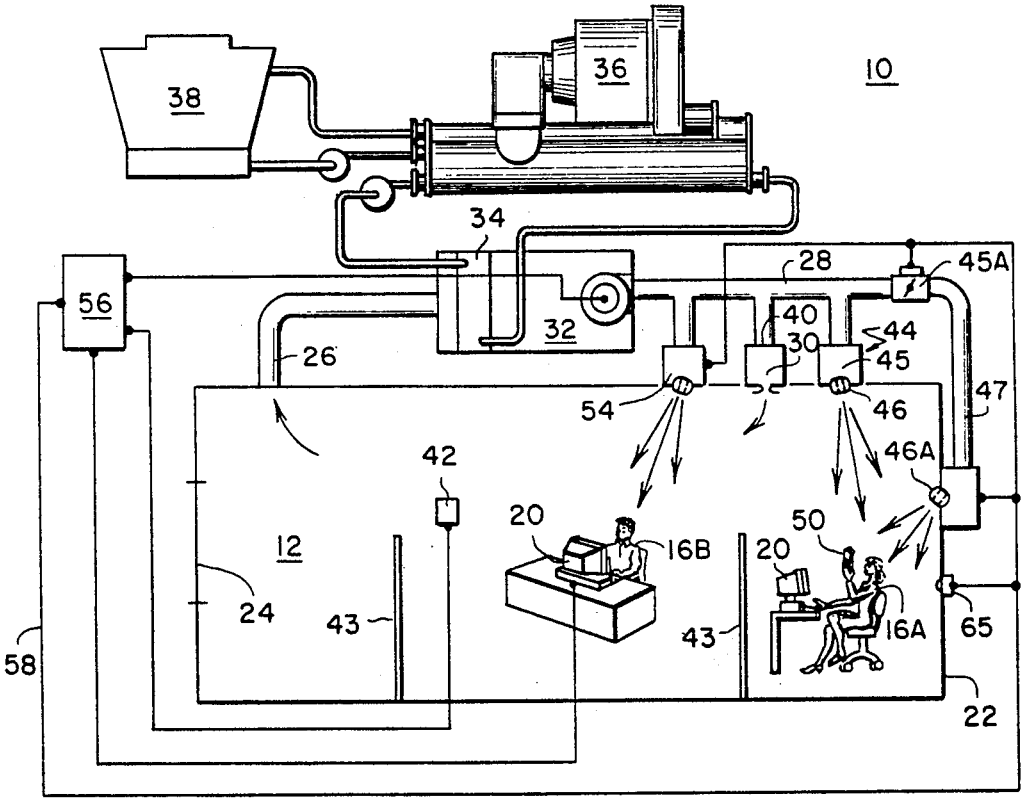
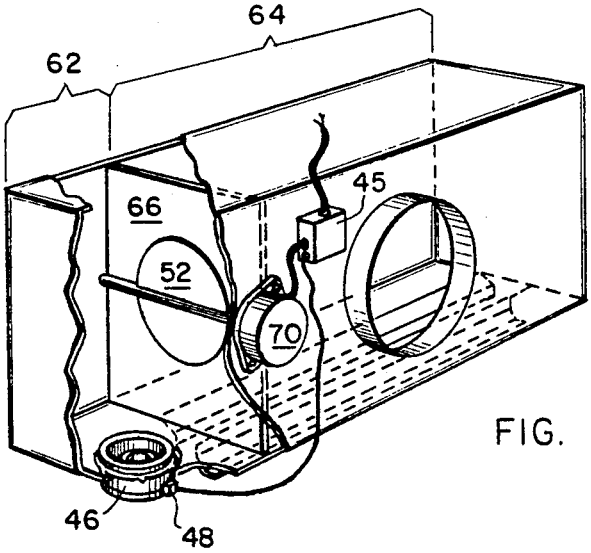
FIG. 4

SYSTEM FOR PROVIDING INDIVIDUAL COMFORT CONTROL

BACKGROUND OF THE INVENTION

The present invention is directed to air distribution system for HVAC equipment, and more particularly, to a method and apparatus for providing individual comfort control by minimizing the size of the air distribution zones.

The temperature of an air conditioned environment is generally modulated by an HVAC and air distribution system based upon data provided by a zone sensor. The zone sensor data typically includes operating mode, setpoint, and actual temperature. The zone sensor is positioned in the environment to be controlled at a locale representative of the overall environment. Invariably, this results in discomfort for some occupants of the zone, including those occupants located in peripheral areas. In fact, studies have documented that 50% of a building's occupants are uncomfortable about 50% of the time regardless of their location or the building's HVAC design. These occupants perceive the conditioned air as either too warm or too cold even when the building setpoints are consistently maintained.

Additionally, the use of modular furniture such as movable half-walls for office environments can seriously disrupt airflow patterns within an environment. This modular furniture forms barriers to airflow, thereby creating nonhomogeneous temperature conditions in the form of heat or cold concentrations.

U.S. Pat. No. 4,135,440 to Schmidt et al. attempts to provide a solution to this problem by connecting a riser tube to a supply air point to thereby direct supply air through the riser tube to a discharge head supported by the riser tube. The discharge head has a structure which causes the supply air to fan out in a cone over an occupant at a work station. However, riser (or drop) tubes in a work environment are obstructive, unsightly, and costly. Additionally, this patent is not amenable to providing conditioned air differing in temperature from the supply air, and fails to provide any automatic control over airflow. Also, there are very limited retrofit applications for this type of patent.

SUMMARY OF THE INVENTION

It is an object, feature and advantage of the present invention to solve the problems of prior air distribution systems.

It is an object, feature and advantage of the present invention to provide an individual with control over an individual comfort control system.

It is an object, feature and advantage of the present invention to minimize the size of the air distribution zones.

It is an object, feature and advantage of the present invention to control an individual's comfort by varying the velocity of air directed into the individual's area.

It is an object, feature and advantage of the present invention to provide a personal comfort system which is easily connectable to air distribution equipment.

It is an object, feature and advantage of the present invention to provide an individual within a zone with a preferred temperature variation in personal comfort from the overall environment of the zone.

It is an object, feature and advantage of the present invention to allow an individual in an open environment to remotely control a personal comfort device.

It is an object, feature and advantage of the present invention to provide a personal comfort system applicable to modular office furniture.

It is an object, feature and advantage of the present invention to provide a personal comfort device which interacts with a building automation system.

It is an object, feature and advantage of the present invention to provide a personal comfort device which can easily be retrofitted to existing air distribution systems.

It is an object, feature and advantage of the present invention to provide a personal comfort device which supplements a building HVAC system.

It is an object, feature and advantage of the present invention to make indoor air quality truly accessible to the individual.

It is an object, feature and advantage of the present invention to provide measurable air quality levels for individuals.

It is an object, feature and advantage of the present invention to provide a personal comfort device which can be remotely controlled.

It is an object, feature and advantage of the present invention to provide a personal comfort device which is remotely controllable by wireless means.

It is an object, feature and advantage of the present invention to provide a personal comfort device which varies the speed of airflow through the device.

It is an object, feature and advantage of the present invention to provide a directional personal comfort control device.

It is an object, feature and advantage of the present invention to provide a directional personal comfort device which can be remotely directed.

It is an object, feature and advantage of the present invention to provide a personal comfort device which operates as a stand alone assembly.

It is an object, feature and advantage of the present invention to provide a personal comfort device which functions in conjunction with an air terminal unit such as an air diffuser.

It is an object, feature and advantage of the present invention to provide a personal comfort device including an integral fan.

It is an object, feature and advantage of the present invention to provide a personal comfort device including an auxiliary heating element.

It is an object, feature and advantage of the present invention to provide a personal comfort device including a bypass air damper.

The present invention provides a system for providing individual comfort control. The system includes means, such as an air diffuser, for distributing conditioned air to an environment; and a personal comfort device for selectively providing conditioned air to a portion of the environment; and means for remotely controlling the operation of the personal comfort device.

The present invention provides a method of providing person comfort control. The method includes the steps of: distributing air to an environment by means of an air distribution system; and providing supplemental air distribution in response to indications of personal discomfort.

The present invention provides in combination, an air diffuser for distributing conditioned supply air to an environment; a personal comfort device for selectably providing conditioned supply air to a portion of the environment; and means for remotely controlling the operation of the air providing means.

BRIEF DESCRIPTION OF THE DRAWINGS

FIG. 1 shows an air distribution system including the personal comfort device of the present invention.

FIG. 4 shows the personal comfort device of the present invention in conjunction with an air terminal unit.

DETAILED DESCRIPTION OF THE DRAWINGS

Figure 2:
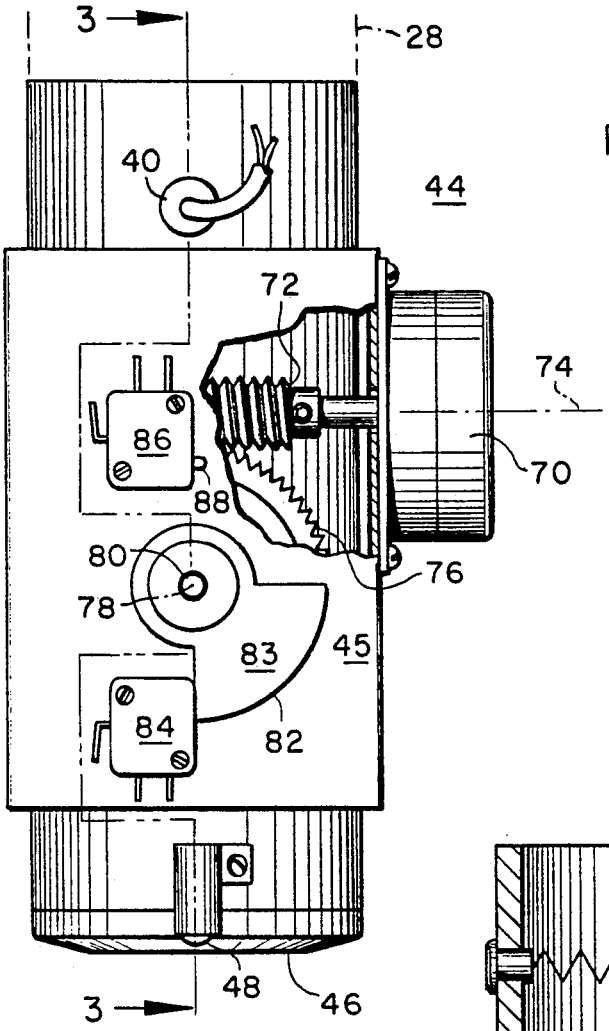
FIG. 2 shows a top plan view of the personal comfort device of the present invention as a stand alone assembly.

FIG. 1 shows an air distribution system 10 for a typical environment 12. Heat flows to and from the environment 12 through a series of heat transfer operations.

During normal cooling operation, heat enters each environment 12 from internal sources such as people 16, lights and equipment 20, and from external sources such as infiltration through walls 22, conduction through walls 22 and radiation through windows 24. Warm air is removed from the environment 12 by a return air stream 26 and is replaced by cool supply air 28 from a terminal unit 30. At an air handler 32, warm return air rejects heat to cool water flowing within a heat exchange coil 34. The warm water exiting from the coil 34 rejects its heat to refrigerant within a water chiller 36 located elsewhere. The refrigerant in turn rejects heat to a condenser or cooling tower 38.

During normal heating operation, heat leaves the environment 12 and is replaced by warm supply air from the terminal unit 30. A heating element 40 in the terminal unit 30 can provide the heat, or heat can be extracted at the air handler 32 from warmer water flowing within the heat exchange coil 34.

The basic control objective in the environment 12 controlled by the air distribution system 10 is to add or subtract heat by means of the conditioned supply air 28 so that the net amount of heat gained, lost, and stored within the environment 12 is balanced at a comfortable temperature. Although the invention is described in terms of a water chiller system, it should be recognized that the invention is applicable to all ducted air conditioning systems including, for example, water source heat pump systems having a source of filtered fresh air.

To achieve this goal a zone sensor 42 is provided within the environment 12 at a location representative of the overall environment 12. The zone sensor 42 provides mode of operation, setpoint and actual temperature data to the air handler 32 so that the air handler 32 can modulate or modify the conditioned supply air 28. The representative location of the zone sensor 42 ensures that, on the average, the temperature in the environment 12 is pleasing to the average person 16B located adjacent the zone sensor 42. However, people 16A located in peripheral areas of the environment 12 as well as people 16A who are naturally warmer or colder than the average, can experience discomfort in the environment 12. Additionally, open areas divided into office space by modular furniture such as half walls 43 can create nonhomogeneous conditions within the environment 12 by obstructing airflow and concentrating temperatures within areas of the environment 12

Figure 3:
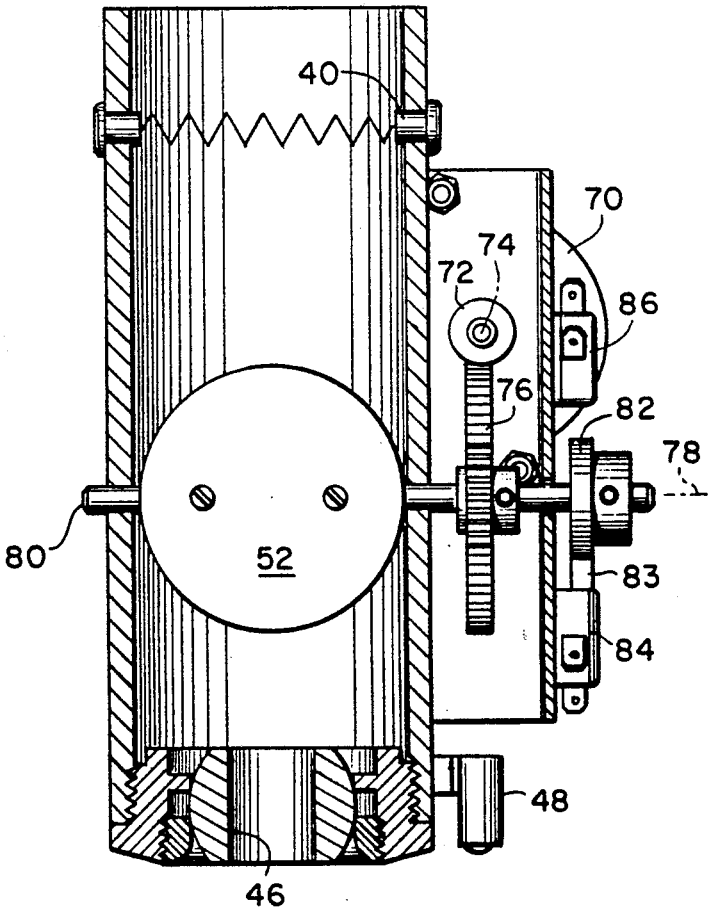
FIG. 3 shows a sectional view of the personal comfort device along lines 3—3 of FIG. 2.

FIGS. 2 and 3 show a personal comfort device 44 having a controller 45 and a directional nozzle 46 connected to a source of conditioned supply air 28. The personal comfort device 44 includes a conventional power source such as a battery, a connection to the building electrical system, a source of solar power or some combination of all three. The personal comfort device 44 also includes means, such as a wireless infrared receiver 48, for receiving a wireless signal from a person 16A having means, such as an infrared transmitter 50, for transmitting a wireless signal. This allows that person 16A to indicate that the person 16A is either too warm or too cold, and that personal comfort control is desired. Ultrasonic, radio frequency and spread spectrum radio frequency transmission media are also contemplated as alternative wireless transmission means.

Upon receipt of a wireless signal indicating discomfort, a damper motor 70 is actuated in a first direction to open a damper 52, and in a second direction to close the damper 52. The damper motor 70 accomplishes this by turning an endless-type screw axle 72 which is aligned with the damper motor axis 74. The screw axle 72 in turn drives a cog wheel 76 having an axis 78. A pivot rod 80 is aligned with the cog wheel axis 78 and rigidly attached to the cog wheel 76. The damper 52 is rigidly attached to the pivot rod 80 so that the damper 52 turns as the cog wheel 76 turns. A limiting device 82 is provided so that the damper 52 and the cog wheel 76 only turn thru an arc of 90°, i.e. between fully open and fully closed. The limit device 82 includes a travelling portion 83 rigidly attached to the pivot rod 80, and limit stops 84 and 86 which may provide electromechanical sensors 88 which indicate to the controller 45 when a limit stop 84, 86 has been reached.

When the personal comfort device 44 receives a signal indicating that a person is uncomfortable and that personal comfort control in the form of cooling is desirable, the personal comfort device 44 activates the damper motor 70 to open the damper 52 and provide cool air to the person. Alternatively, a system powered device, or a mechanical spring device may be used to open a damper 52 and allow cool conditioned air to be directed at the person. However, if the signal indicates that the person is too cool and that supplemental heating is desired, the damper 52 is opened and the warm air is provided to the individual if the air handler 32 is in the warming mode. Otherwise the damper 52 is opened and the auxiliary heating element 40 is used to reheat the air and thereby warm the person 16A.

In the preferred embodiment of the present invention the nozzle 46 of the personal comfort device 44 is manually adjustable to point at a predetermined locale, preferably a work area. When a person 16A at the work area feels discomfort, this person presses a switch, button or other device on the infrared transmitter 50 indicating that the person is either too warm or too cool. The transmitter 50 then transmits that indication to the receiver 48 and the personal comfort device 44 responds accordingly. FIG. 1 also shows an embodiment where the directional nozzle 46A and the controller 45A of the personal comfort device 44 are implemented as distinct and separate elements 45A, 46A separated by a duct 47.

An advantage of the present invention is that normal control of the environment 12 by the air distribution system 10 is maintained, while an occupant may be respectively receiving warmer (or colder) air than the environment 12. Effectively, the zone sensor 42, air handler 32, and terminal unit 30 continue to regulate the environment 12, while the personal comfort device 44 provides localized temperature variations within the environment 12. Another advantage of the invention is that a second personal comfort device 54 can be located within the same environment 12 and allow one occupant to increase his comfort by requesting extra heated air from the personal comfort device 54, while another occupant simultaneously is requesting extra cooled air from the personal comfort device 44. Additionally, if the equipment 20 of the person 16B is a personal computer connected to a building automation system 56, the occupant can indicate personal discomfort using the personal computer 20 instead of through use of an infrared transmitter 50. The indication of personal comfort is then relayed to the building automation system and to the personal comfort device 54 by a communications link 58.

FIG. 4 shows a second preferred embodiment of the present invention where a personal comfort device 62 forms an integral part of an air terminal unit such as a linear slot diffuser 64. Preferably, the personal comfort device 62 is independently connected to a source of conditioned supply air 28, or alternatively, a partition 66 separates the personal comfort device 62 from the linear slot diffuser 64 so that the linear slot diffuser 64 may provide normal distribution of supply air to the environment 12 while the personal comfort device 62 provides supplemental air to a person experiencing discomfort. When an occupant feels discomfort, the occupant transmits a signal to the receiver 48 of the personal comfort device 62 using the transmitter 50, or a personal computer linked to the building automation system 56. In turn, the personal comfort device 62 actuates the damper 52 by means of the damper motor 70. Additional supply air is then directed directly to the occupant by the nozzle 46.

Figure 5:
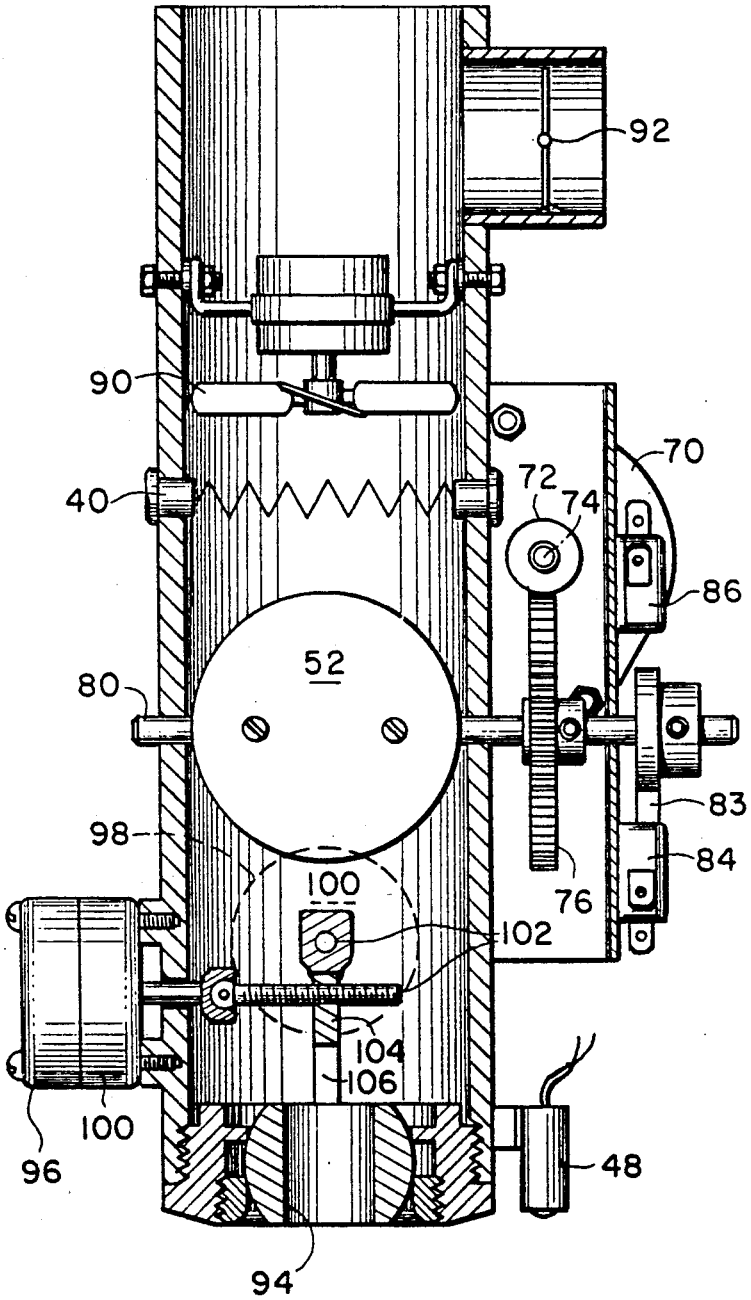
FIG. 5 shows a sectional view of the personal comfort device of the present invention including a remotely controllable nozzle assembly.

As shown in FIG. 5, various options may be added to enhance the operation of the personal comfort device 44. Such options include an integral fan 90, a bypass air damper 92, and/or an articulated nozzle 94 capable of remotely controlled direction setting. The personal comfort device 44 can also include air filtration equipment, and/or a white noise source, to provide increased individual privacy.

The remotely controlled direction setting is, for example, accomplished by a pair of linear actuators 96 and 98. Each linear actuator 96, 98 includes a bi-directional motor 100 turning a screw 102. The screws of the respective linear actuators 96, 98 are positioned at right angles to each other and pass through a threaded sleeve 104 having threads engaging each screw 82. The threaded sleeve 104 is joined to the nozzle 94 by an attachment 106 so that, as the linear actuators 96, 98 turn their respective screws 84, the sleeve 86 travels along the respective screws 102 and changes the direction of nozzle 94 by means of the attachment 106.

When used for remote direction setting, the transmitter 50 is provided with means, such as directional arrows, for transmitting four signals indicative of four cardinal directions. Each pair of opposing direction signals is applied to a respective linear actuator 96, 98 and the respective opposing directions of the pair are arbitrarily used to designate the direction of rotation for the motor 100. Alternatively, the directional arrows on the keyboard of a personal computer 20 may be used to control the direction of the nozzle 94. The receiver 48 includes a decoder which decodes the signals and forwards these signals in positive or negative forms to the linear actuator 96, 98. The positive or negative form indicates to the actuator 96. 98 which direction to turn the bidirectional motor 100 and thereby which direction the nozzle 94 is pointed in.

What has been disclosed is a system for providing individual comfort within an environment controlled by an air distribution system. It will be readily apparent that many alterations and modifications are possible. In one alternative, the personal comfort device 44 can be built into the modular furniture or into the building wall 22 or support structure and receive supply air from post type drops from the ceiling or from under the floor. If the personal comfort device 44 is built into the building structure 22 or into the modular furniture 43, the communications link 58 between the personal comfort device 44 and the transmitter 50 may be more advantageously implemented as a physical connection such as a twisted pair wire link 58 between the personal comfort device 44 and a switch 65. All such modifications and alterations are contemplated to be within the spirit and scope of the present invention as embodied by the following claims.

What is claimed is:

1. A system for providing individual comfort control comprising:

means for distributing conditioned air into an environment including first and second air diffusers;

a first personal comfort device, sharing a common housing with the first air diffuser, for selectively providing supplemental heated conditioned air to a first portion of the environment including means for directing the distribution of the supplemental conditioned air, and a heating element;

a second personal comfort device, sharing a common housing with the second air diffuser, for selectively providing supplemental cooled conditioned air to a second portion of the environment and including means for directing the distribution of the supplemental conditioned air;

means for transmitting wireless communications from a remote locale to the first and second personal comfort devices;

means, operatively associated with the wireless transmitting means, for remotely controlling the operation of the first and second personal comfort devices;

means, operatively associated with the wireless transmitting means, for remotely directing the distribution of the supplemental conditioned air by the respective distribution directing means of the first and second personal comfort devices.

2. The system of claim 1 wherein the first personal comfort device and the air distribution means share a common duct.

3. In combination a first housing including a first air diffuser for distributing conditioned supply air into an environment and a first personal comfort device for selectably and directionally providing conditioned supply air to a first portion of the environment, the first personal comfort device including an auxiliary heating element;

a second housing including a second air diffuser for distributing conditioned supply air into the environment and a second personal comfort device for selectably and directionally providing conditioned supply air to a second portion of the environment;

first and second means for indicating personal comfort by remote wireless transmissions;

means, associated with the first personal comfort indicating means, for remotely controlling the operation of the first personal comfort device and the direction of the supplemental conditioned supply air distribution;

second means, associated with the second personal comfort indicating means, for remotely controlling the operation of the second personal comfort device and the direction of the supplemental conditions supply air distribution; and wherein the first personal comfort device provides supplemental heated air to a first portion of the environment, and the second person comfort device simultaneously provides supplemental cooled air to a second portion of the environment.

4. The combination of claim 3 wherein the remote control means includes an infrared transmitter.

5. The combination of claim 3 wherein the remote control means further includes means for indicating personal comfort.

6. The combination of claim 3 wherein the first personal comfort device includes a bypass damper or an integral fan.

7. A method of providing personal comfort control including the steps of:

distributing air to an environment by means of an air distribution system;

transmitting a first wireless signal to indicate personal discomfort of a first person;

providing heated supplemental air distribution from a first personal comfort device associated with a first diffuser in response to the first indication of personal discomfort of the first person;

remotely controlling the direction of the heated supplemental air distribution;

transmitting a second wireless signal to indicate personal discomfort of a second person;

simultaneously providing cooled supplemental air from a second personal comfort device associated with a second diffuser to the second person suffering discomfort; and remotely controlling the direction of the cooled supplemental air distribution.

* * * * *